US006280221B1

(12) United States Patent
Fukase et al.

(10) Patent No.: US 6,280,221 B1
(45) Date of Patent: Aug. 28, 2001

(54) ELECTRIC CONNECTOR HOUSING AND METHOD FOR DETECTING ENGAGEMENT OF THE SAME

(75) Inventors: Yoshihiro Fukase; Toru Nagano, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/630,638

(22) Filed: Aug. 1, 2000

(30) Foreign Application Priority Data

Aug. 2, 1999 (JP) ..... 11-218678

(51) Int. Cl.[7] ..... H01R 4/54

(52) U.S. Cl. ..... 439/315; 439/318

(58) Field of Search ..... 439/315, 489, 439/312, 318

(56) References Cited

U.S. PATENT DOCUMENTS 4,497,530 * 2/1985 Shannon ..... 439/315
5,823,807 * 10/1998 Yamasaki ..... 439/489
5,980,293 * 11/1999 Nagano ..... 439/489
6,126,480 * 10/2000 Kawase et al. ..... 439/489

* cited by examiner

*Primary Examiner*—Neil Abrams
*Assistant Examiner*—Phuong K T Dinh
(74) *Attorney, Agent, or Firm*—Armstrong, Westerman. Hattori, McLeland & Naughton, LLP

(57) ABSTRACT

An electric connector housing 1 consisting of a pair of connector housings comprises a receiving chamber 34 which is formed on an outer face of a rotatable member 3 fitted to one of connector housings 2 and radially extending therefrom, and a member 4 for detecting an engagement of the connector housings which is inserted into the receiving chamber movably back and forth and adapted to engage with the rotatable member 3 at its one end before a start of the engagement and after the engagement, thereby to stop the rotation of the rotatable member. The other of the connector housings 5 includes an annular wall 60 which is bulgingly formed at an outer face thereof in a circumferential direction, and a sliding face 61 formed on the annular wall so as to face with the rotatable member, the other end of the member for detecting the engagement being abutted against the sliding face at the start of the engagement and sliding along the sliding face during the engagement. With this structure, positioning work of the one connector housing with respect to the other will be reduced, an erroneous excessive rotation of the rotatable member after the engagement will be prevented, and an incompletely engaged state can be easily detected by visual inspection.

3 Claims, 16 Drawing Sheets

ELECTRIC CONNECTOR HOUSING AND METHOD FOR DETECTING ENGAGEMENT OF THE SAME

BACKGROUND OF THE INVENTION

1. Field of the Invention

The present invention relates to an electric connector housing, and more particularly, to the electric connector housing which can be assembled by rotating a rotatable ring, and a method for detecting an engagement thereof.

2. Description of the Related Art

Conventionally, there is disclosed an electric connector housing as shown in FIG. 22 as disclosed in Japanese Patent Publication No. 2-257581 of unexamined patent application, and U.S. Pat. No. 4,963,106.

An electric connector housing 90 of the type is composed of one connector housing 91 and the other connector housing 92 which is adapted to receive the one connector housing 91 into an engagement therewith.

The one connector housing 91 is composed of a housing body 93, a rotatable member 94 which is rotatably fitted to an outer face of the housing body 93, and an actuating boss (not shown) provided on an inner face of the rotatable member 94. The other connector housing 92 is composed of a housing body 95, a hood 96 which is bulgingly formed on an outer face of the housing body 95, and a cam groove 97 formed at an outer face of the hood 96. Numeral 98 designates a panel assembled to the other connector housing 92.

Assembling of the electric connector housing 90 is conducted by inserting the actuating boss into the rotatable member 94, rotating the rotatable member 94, and inserting the one connector housing 91 into the hood 96 for the other connector housing 92 to bring both the connector housings 91, 92 into an engagement.

However, because the rotatable member 94 easily rotates along the outer face of the housing body 93 of the one connector housing 91, there has arisen such an inconvenience that the housing body 93 and the rotatable member 94 must be positioned with respect to the other connector housing 92 before starting the engagement.

Moreover, because a rotation angle (rotation amount) of the rotatable member 94 cannot be judged through visual inspection, there has been a fear that the rotatable member 94 may be overrotated after the engagement, or that the rotation of the rotatable member 94 may be suspended during the engagement.

Further, because a state of engagement between a pair of the connector housings 91, 92 cannot be detected by the visual inspection, it has been feared that both the connector housings 91, 92 are forcibly engaged with each other by mistake, even though they are in an incompletely engaged state. This would have damaged respective terminals inside (not shown).

In view of the above described problems, an object of the invention is to provide an electric connector housing in which positioning work of the one connector housing with respect to the other is reduced to the most, an erroneous excessive rotation of the rotatable member after the engagement is prevented, and the incompletely engaged state can be easily detected by visual inspection, and a method for detecting the engagement.

SUMMARY OF THE INVENTION

In order to achieve the above described object, there is provided an electric connector comprising a pair of connector housings which are adapted to engage with each other by means of a rotation of a rotatable member fitted around an outer face of one of the connector housings, which comprises a receiving chamber formed on an outer face of the rotatable member radially extending therefrom, a member for detecting an engagement of the connector housings which is inserted into the receiving chamber movably back and forth, and adapted to engage with the rotatable member at its one end before a start of the engagement and after the engagement, thereby to stop the rotation of the rotatable member, the other of the connector housings including an annular wall which is bulgingly formed at an outer face thereof in a circumferential direction, and a sliding face formed on the annular wall so as to face with the rotatable member, the other end of the member for detecting the engagement being abutted against the sliding face at the start of the engagement and sliding along the sliding face during the engagement.

According to a second aspect of the invention, the member for detecting the engagement is adapted to be detached from the sliding face immediately after the engagement and to be elastically returnable to a state before the start of the engagement.

There is also provided, according to a third aspect of the invention, a method for detecting an engagement of the above described electric connector housing, wherein a pair of the connector housings can be engaged before a termination of the rotation of the rotatable member, and a state of the engagement of the connector housings is detected by whether or not the member for detecting the engagement has been returned to the state before the start of the engagement.

According to the invention, the chamber for receiving the detecting member is projectingly formed at the outer face of the rotatable member which is rotatably fitted to the outer face of one of the connector housings, and the member for detecting the engagement is inserted into the receiving chamber so as to move back and forth in a direction of inserting terminals. The other connector housing includes the annular wall which is bulgingly formed circumferentially at the outer face thereof, and the sliding face which is formed on the annular wall so as to face with the rotatable member. Before a pair of the connector housings start to engage, the rotatable member is restrained from rotating, because one end of the engagement detecting member is engaged with the rotatable member. At the start of the engagement, the other end of the engagement detecting member is abutted against the sliding face on the annular wall, and during the engagement, the other end of the engagement detecting member slides along the sliding face. Then, after the engagement is completed, the one end of the engagement detecting member restrains the rotation of the rotatable member.

According to the aforesaid second aspect of the invention, immediately after a pair of the connector housings have been engaged, the engagement detecting member is detached from the sliding face on the annular wall and elastically returned to the state before the start of the engagement. Thus, the state of the engagement detecting member will be the same before the start of the engagement and immediately after the engagement.

According to the aforesaid third aspect of the invention, a pair of the connector housings are able to be engaged before reaching the end of the rotation of the rotatable member, and so, the state of the engagement of a pair of the connector housings can be detected by whether the engagement detecting member has been returned to the original state or not. In other words, in case where the engagement detecting member has been returned to the original state after the termination of the rotation, this means that a pair of the connector housings have been engaged. On the other hand, in case where the engagement detecting member has not been returned to the original state, this means that a pair of the connector housings have not been engaged.

DESCRIPTION OF THE PREFERRED EMBODIMENT

Figure 1:
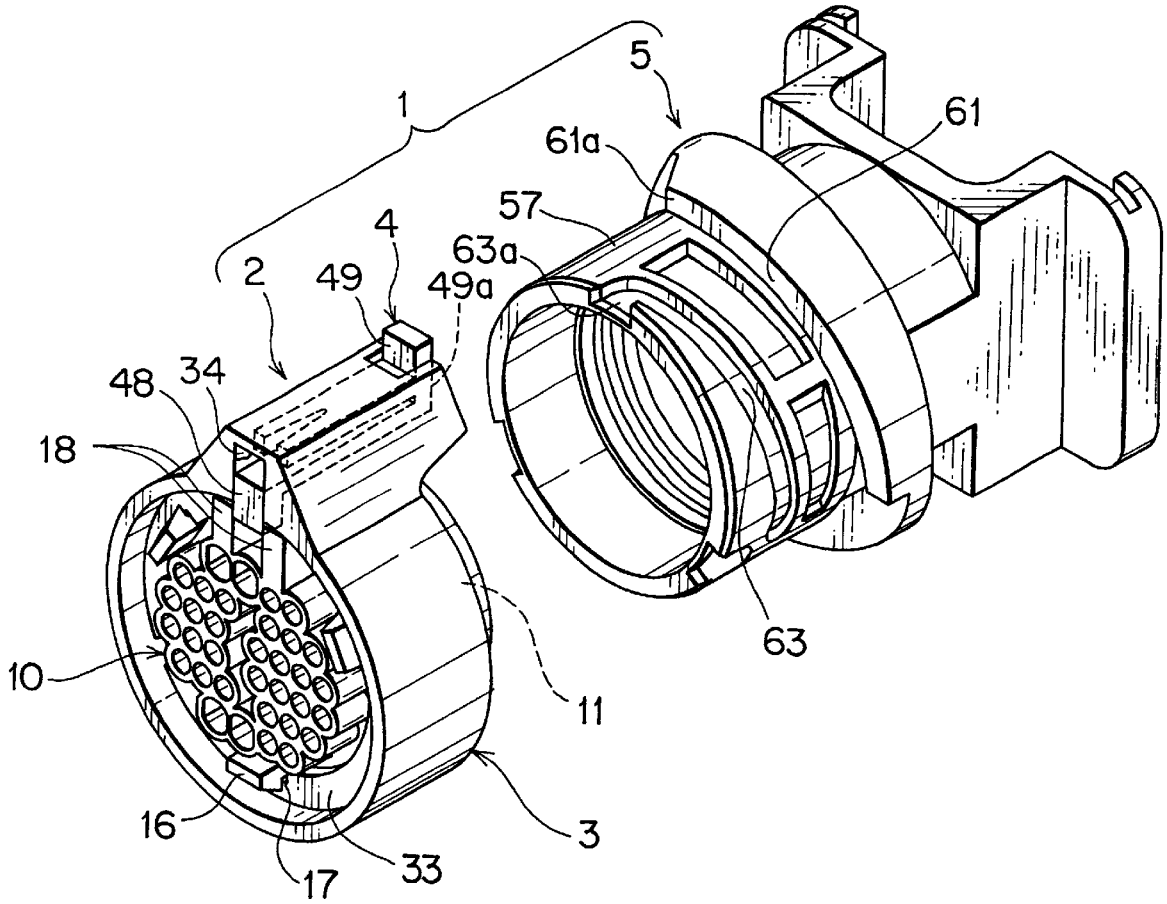
FIG. 1 is an exploded perspective view showing one embodiment of an electric connector housing according to the present invention.

Now, referring to the drawings, an embodiment of the present invention will be described. Although there is described, in this embodiment, a connector housing comprising a male connector housing as the one connector housing and a female connector housing as the other connector housing, both formed in a round shape in cross section, the description is almost the same with reference to other types of the connector housings.

FIG. 1 to FIG. 21 show an embodiment of an electric connector housing according to the invention.

As shown in FIG. 1, this electric connector assembly 1 is composed of a male connector housing 2 and a female connector housing 5 adapted to be engaged with the male connector housing 2. Both the male connector housing 2 and the female connector housing 5 are made of insulating material.

Figures 2, 2A:
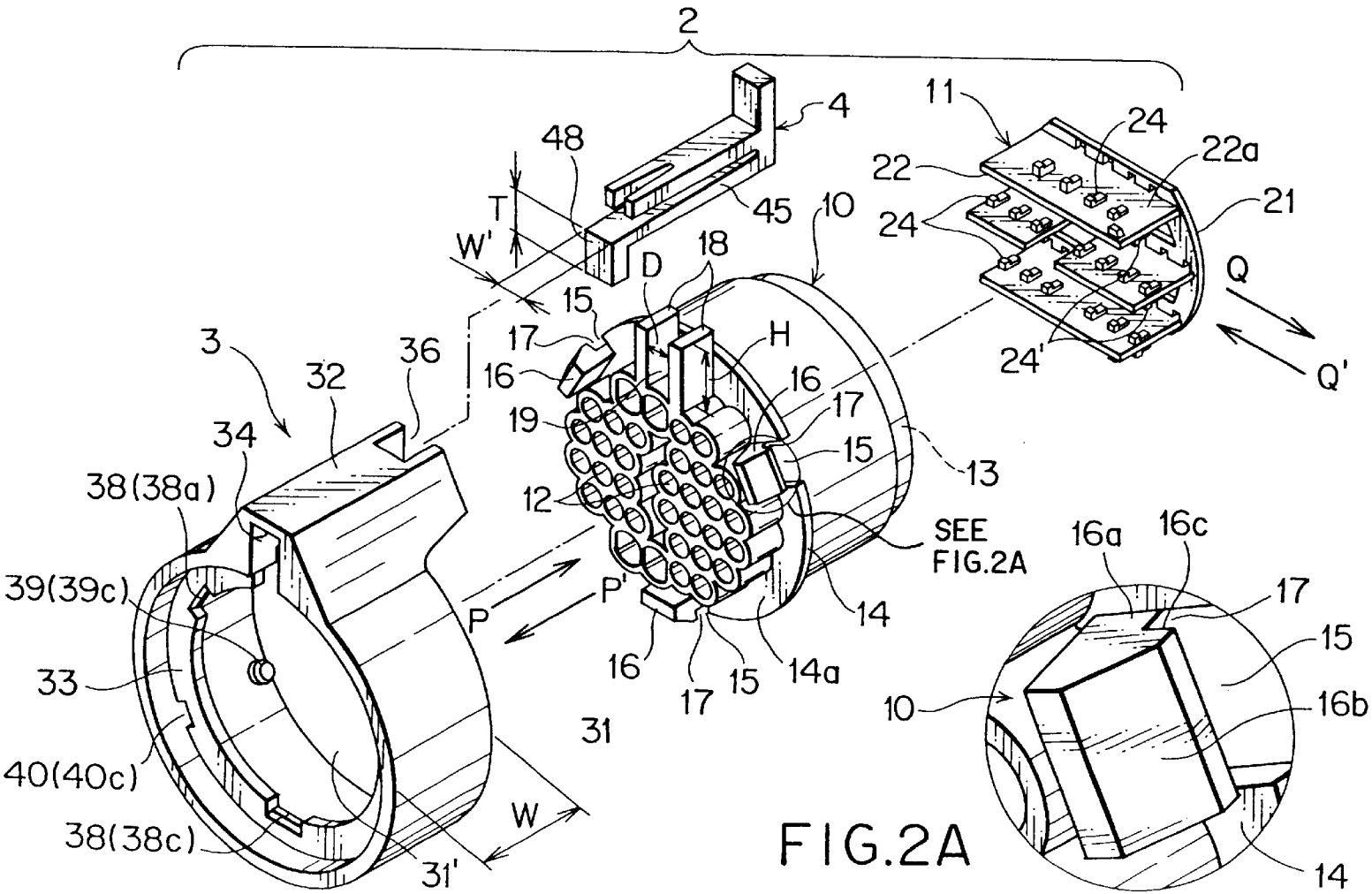
FIG. 2 is an exploded perspective view of a male connector housing of FIG. 1.

As shown in FIGS. 1 and 2, the male connector housing 2 is composed of a male housing body 10, a female terminal holder 11, a ring member 3 (rotatable member in the claims), and an engagement detecting member 4 (hereinafter referred to as a detecting member). The male housing body 10 is formed in a round shape in cross section. The female terminal holder 11 is fitted in the male housing body 10 so as to be slidable in a direction Q or Q' which is perpendicular to a direction of inserting female terminals or forward direction P. The ring member 3 is mounted on an outer face of the male housing body 10 so as to be rotatable along the outer face. The detecting member 4 is fitted so as to be movable back and forth in a direction P of inserting the female terminals.

The male housing body 10 includes a plurality of terminal receiving chambers 12. In a forward end portion of the terminal receiving chambers 12 is formed a holder receiving room 13 adapted to receive the female terminal holder 11. Around the outer face of the male housing body 10 at a side of the holder receiving room, is provided a locking plate 14 having three cutouts 15, 15, 15. The three cutouts 15, 15, 15 are equidistantly arranged with respect to the locking plate 14.

Three locking arms 16 project from the outer face of the male housing body 10 in a direction opposite to the terminal insertion direction P or a backward direction P'. In each of the cutouts 15 is disposed an upright portion 16*a* of one locking arm 16. In other words, the cutouts 15 and the locking arms 16 coincide respectively with each other in number and with respect to positions to be arranged.

Each of the locking arms 16 is formed with a locking hook 16*b* at its free end in a radially extending direction. A forward end face 16*c* of the locking hook 16*b* is formed flat in a direction intersecting with the forward direction. Between the forward end face 16*c* of the locking hook 16*b* and a rearward end face 14*a* of the locking plate 14, are formed spaces 17 for receiving an engaging wall.

Between the two adjacent cutouts 15, 15 are provided a pair of locking ribs 18, 18 projecting from a rear end portion of the male housing body 10 in radial direction. A projection receiving gap 19 is formed between a pair of the locking ribs 18, 18. The locking ribs 18, 18 project by a height H which is longer or higher than the locking plate 14.

Figure 3:
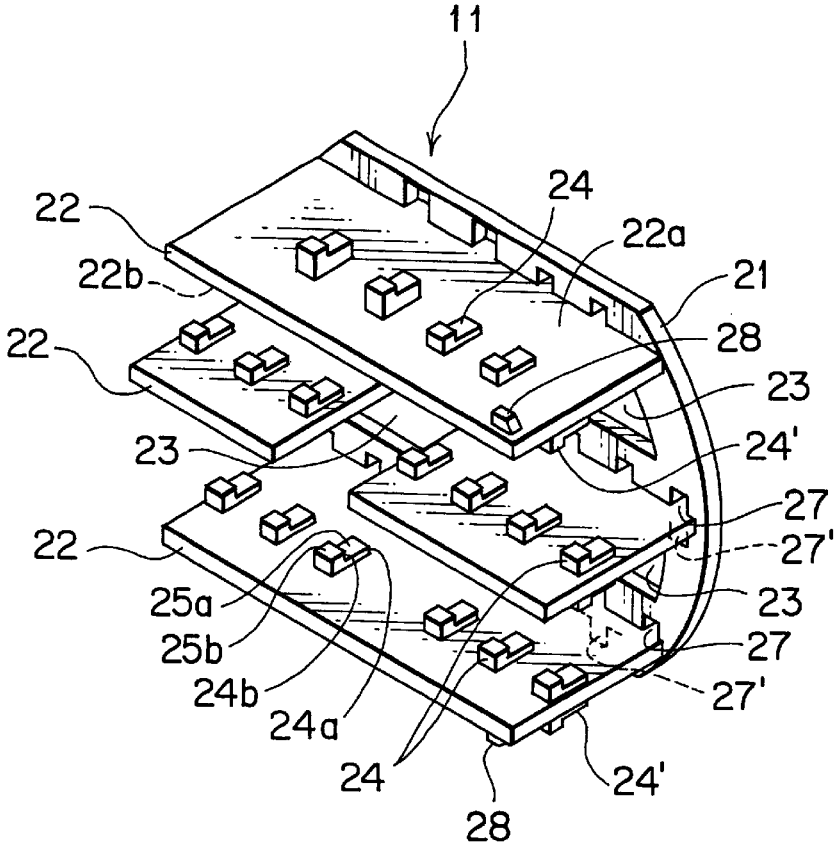
FIG. 3 is an enlarged perspective view of a female terminal holder of FIG. 2.

As shown in FIGS. 2 and 3, the female holder 11 includes a base plate 21 which is slidably arranged in the direction Q or Q' perpendicular to the female terminal inserting direction P and provided with three holding plates 22, 22, 22 extending from the base plate 21 in the female terminal inserting direction P in a substantially E-shape.

The three holding plates 22, 22, 22 are arranged at an upper position, at an intermediate position, and at a lower position respectively, in parallel with one another. Between the two adjacent holding plates 22, 22 are respectively formed slits 23 through which the terminals are inserted. A plurality of engaging step portions 24, 24' are respectively provided on an upper face 22*a* and a lower face 22*b* of each of the holding plates 22.

Figure 4:
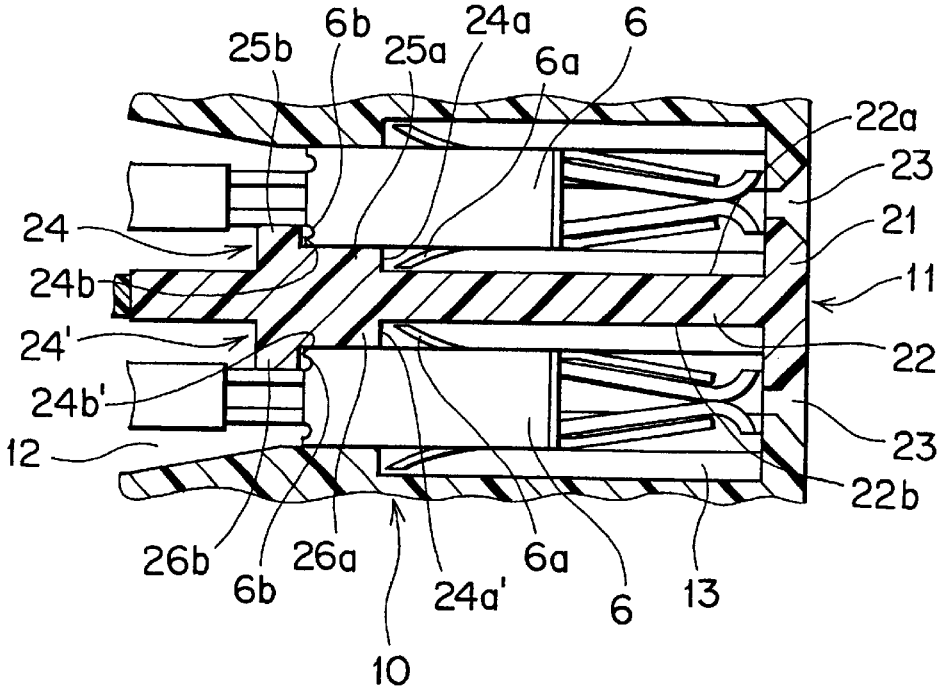
FIG. 4 is an explanatory view showing female terminals held by the female terminal holder of FIG. 3.

As shown in FIGS. 3 and 4, the engaging step portion 24 is of an inverted L-shape with respect to the upper face 22*a* of the holding plate 22, while the engaging stepped portion 24' is of an L-shape with respect to the lower face 22*b* of the holding plate 22.

The engaging step portion 24 of the inverted L-shape has a first step 25*a* and a second step 25*b* ascending rearwardly from the upper face 22*a*. Between the upper face 22*a* and the first step 25*a* is arranged an engaging face 24*a* adapted to lock a flexible locking piece 6*a* of a female terminal 6. Between the first step 25*a* and the second step 25*b* is arranged a shoulder engaging face 24*b* adapted to be engaged with a shoulder 6*b* of the female terminal 6.

In the same manner as described above, the engaging step portion 24' of the L-shape has a first step 26*a* and a second step 26*b* descended rearwardly from the lower face 22*b*. Between the lower face 22*b* and the first step 26*a* is arranged an engaging face 24*a*', while between the first step 26*a* and the second step 26*b* is arranged a shoulder engaging face 24*b*'. Reference numerals 27, 27' are escape holes for a metal mold for resin molding of the step portions 24, 24'.

As shown in FIGS. 2 and 3, locking projections 28, 28 are provided respectively in a rearward corner at the right end of the upper face 22*a* of the upper holding plate 22, and in a rearward corner at the right end of the lower face 22*b* of the lower holding plate 22. The locking projections 28, 28 are adapted to be provisionally or permanently engaged with projections to be engaged (not shown) which are provided on an inner face of the holder receiving room 13. In order to insert the female terminals 6 in the male connector housing 2, the female holder 11 is provisionally engaged in the holder receiving room 13, the female terminals 6 are inserted into the terminal receiving chambers 12, and then, the female holder 11 is shifted from the provisional engagement to the permanent engagement by its sliding movement, thereby locking the female terminals 6 by means of the female holder 11.

Figure 5:
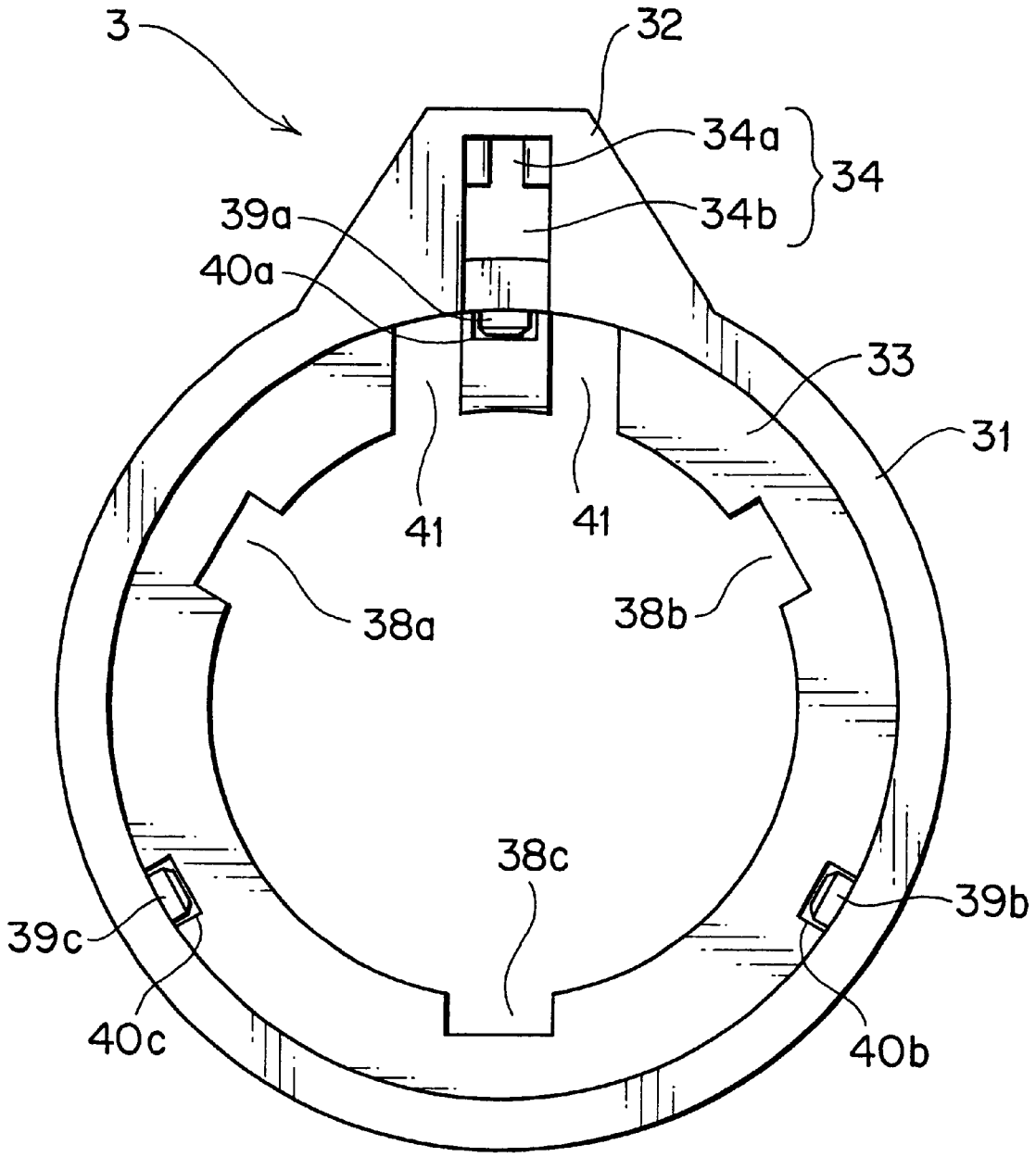
FIG. 5 is an end view of a ring member of FIG. 2 as seen from a direction of inserting terminals.

As shown in FIGS. 2 and 5, the ring member 3 includes a hollow cylindrical member 31, a detecting member receiving wall 32 of an inverted V-shape projecting radially outwardly from the hollow cylindrical member 31, and an annular engaging wall 33 circumferentially provided on an inner face of the cylindrical member 31. The receiving wall 32 projects forwardly in a direction P longer than a width W of the ring member 3.

Figure 6A:
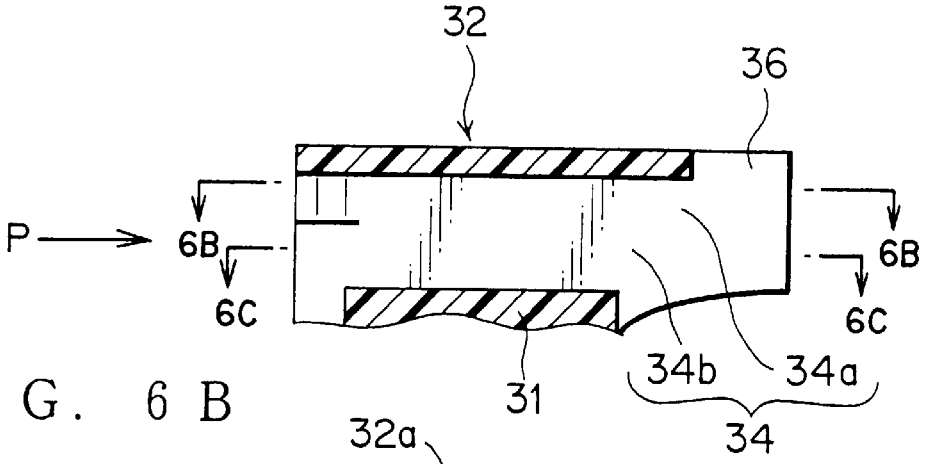
FIG. 6A is a sectional view of a detecting member receiving chamber.
Figure 6B:
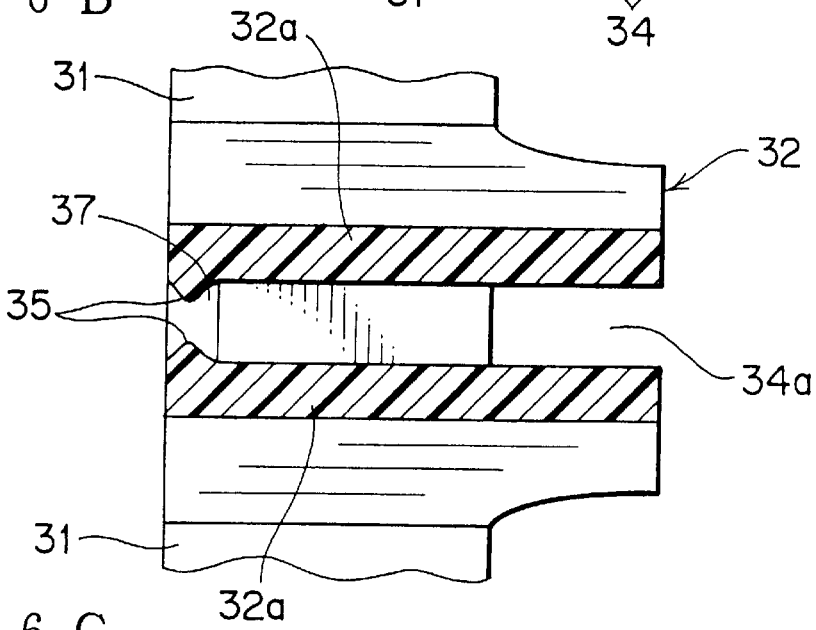
FIG. 6B is a sectional view taken along a line X—X of FIG. 6A.
Figure 6C:
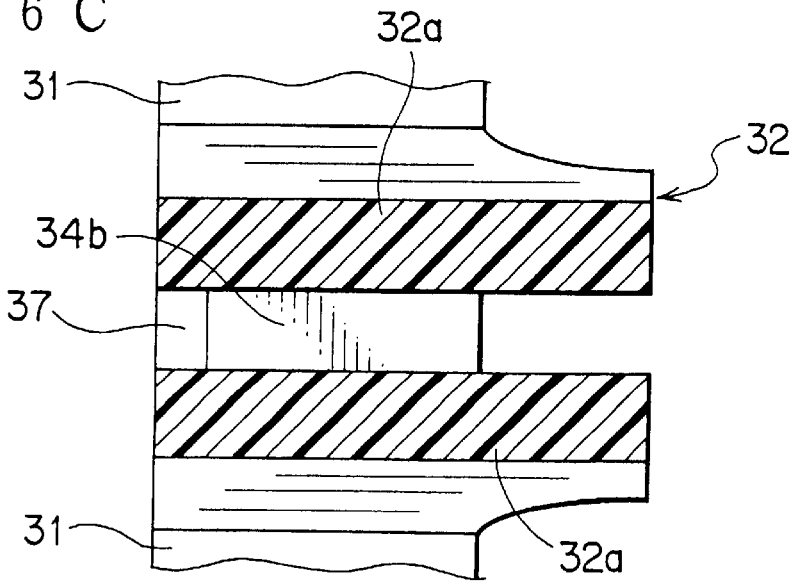
FIG. 6C is a sectional view taken along a line Y—Y of FIG. 6A.

As shown in FIGS. 5 and 6, a detecting member receiving chamber 34 is formed inside the receiving wall 32 in a manner passing through the receiving wall 32 in the terminal insertion direction P (FIG. 6A). An upper half 34*a* of the detecting member receiving chamber 34 is in a form of a bottle neck in a rearward end portion as shown in FIG. 6B. A pair of projected pressing walls 35 in an angled shape are projected from both side walls 32*a*, 32*a* in the rearward end portion of the upper half 34*a*. The upper half 34*a* of the receiving chamber 34 is narrowest between a pair of the pressing walls 35, 35. A cutout 36 for an operating projection is formed in an upper part at a forward end of the receiving wall 32 as shown in FIG. 6A. The cylindrical member 31 is provided with a cutout 37 for a stopper at a position corresponding to a rearward end of the receiving wall 32 as shown in FIG. 6B. A lower half 34*b* is formed straight inside, different from the upper half 34*a*.

The annular engaging wall 33 is equiangularly provided with three cutouts 38*a*, 38*b*, 38*c* (designated by numeral 38 as a representative) for guiding locking pieces at its free end edge. Between two of the locking piece guiding cutouts 38*a* and 38*b*, is arranged the detecting member receiving chamber 34.

Three actuating bosses 39*a*, 39*b*, and 39*c* (designated by numeral 39 as a representative) are equiangularly projected from the inner face of the cylindrical member 31. One of the actuating bosses 39*a* is arranged directly below the detecting member receiving chamber 34, and the other bosses 39*b* and 39*c* are equiangularly arranged on the left and the right hands of the one boss 39*a*.

The annular engaging wall 33 is equiangularly formed with three extracting holes 40*a*, 40*b*, and 40*c* (designated by numeral 40 as a representative) for a metal mold. The mold extracting holes 40 are formed for extracting the metal mold (not shown) when the actuating bosses 39 are molded of resin. The mold extracting hole 40*a* is arranged directly below the detecting member receiving chamber 34, and the other mold extracting holes 40*b* and 40*c* are equiangularly arranged on both sides of the mold extracting hole 40*a*. As seen in FIG. 5, the mold extracting holes 40 and the locking piece guiding cutouts 38 are alternately arranged on the annular engaging wall 33. Because the actuating bosses 39 and the mold extracting holes 40 respectively correspond to each other, the actuating bosses 39 and the locking piece guiding cutouts 38 are alternately arranged as seen in a plan view.

As described above, the actuating boss 39*a* is arranged directly below the detecting member receiving chamber 34 which projects forwardly (in a direction P) from the outer face of the ring member 3. Therefore, by catching a position of the detecting member receiving chamber 34 by visual inspection, positions of the actuating bosses 39 can be recognized. This enables the position of the actuating bosses 39 to be easily confirmed as compared with the conventional structure.

The annular engaging wall 33 is further formed with a pair of rib inserting cutouts 41, 41 in parallel on both sides of the mold extracting hole 40*a*.

Figure 7:
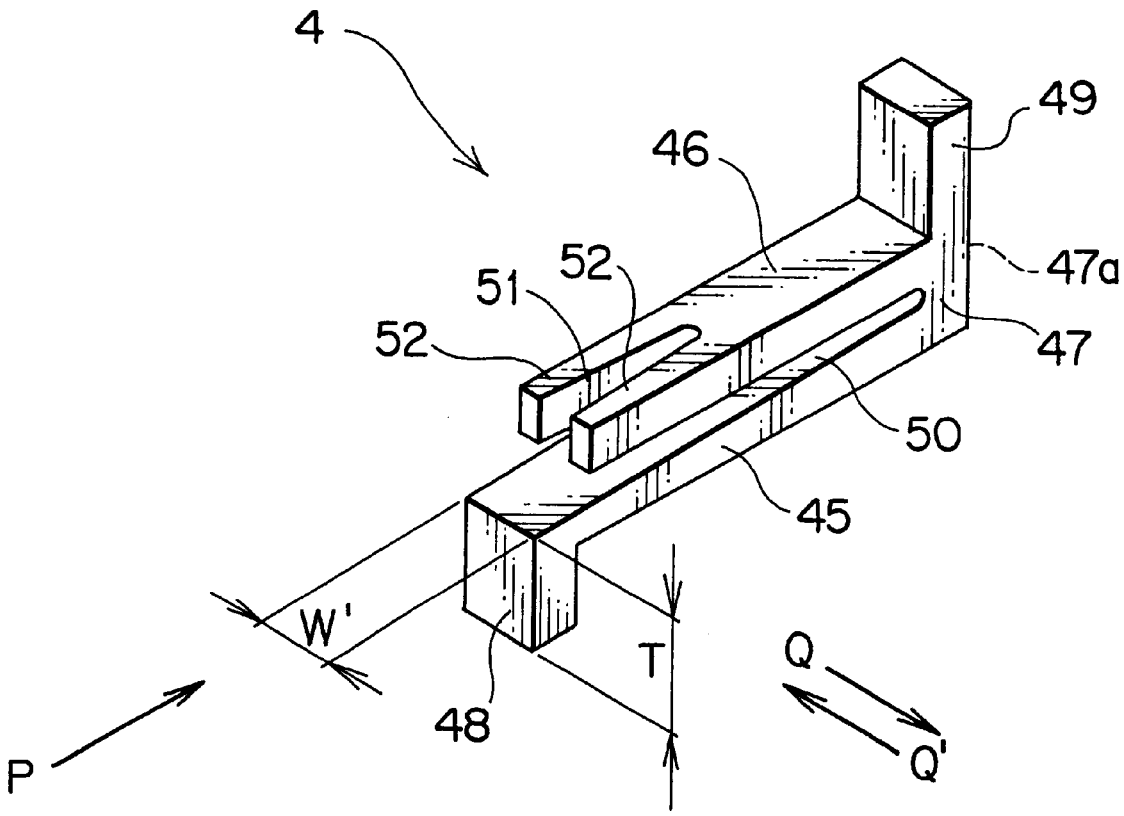
FIG. 7 is an enlarged perspective view of the detecting member of FIG. 2.

As shown in FIGS. 2 and 7, the detecting member 4 is inserted into the detecting member receiving chamber 34 of the ring member 3 so as to move back and forth in the terminal insertion direction (the direction P).

The detecting member 4 consists of an elongated main plate 45, an elongated elastic plate 46 disposed in parallel above the main plate 45, and an operation connecting plate 47 integrally connecting the main body 45 and the elastic plate 46 at their forward ends.

The main plate 45 is longer than the detecting member receiving chamber 34. A width W' of the main plate 45 is approximately equal to a distance D between a pair of the locking ribs 18, 18 provided on the male housing body 10 (W'≈D). A projection 48 as a stopper is integrally formed at a rearward end of the main plate 45 projecting downwardly. The projection 48 has a projected length T which is set so as to engage with the locking plate 14 of the male housing body 10. An operating projection 49 is integrally formed at an upper end of the operation connecting plate 47.

The elastic plate 46 is shorter than the main plate 45. Between the elastic plate 46 and the main plate 45, is set a gap 50 of a desired distance. The elastic plate 46 is formed with a V-shaped notch 51 at its rearward end in the terminal inserting direction. By forming the V-shaped notch 51, the rearward end is provided with a pair of elastic pieces 52, 52 which are flexible in the direction Q and Q' perpendicular to the terminal inserting direction P. A pair of the elastic pieces 52, 52 create an elastic force in the elastic plate 46 by flexing.

Figure 8:
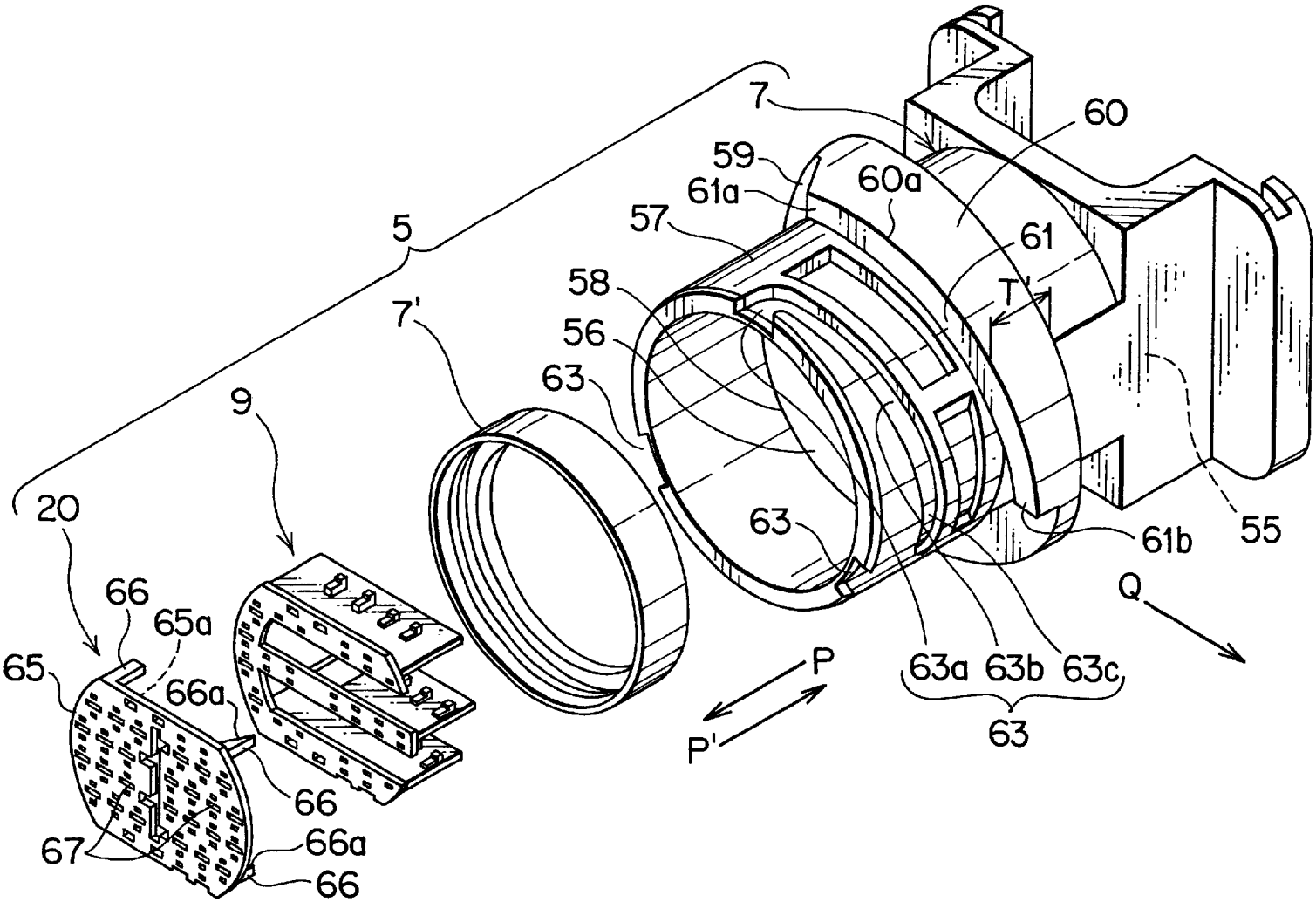
FIG. 8 is an exploded perspective view of a female connector housing of FIG. 1.

As shown in FIGS. 1 and 8, the female connector housing 5 consists of a female housing body 7, a packing 7' contained in the female housing body 7, a male terminal holder 9 for holding male terminals 8, and a jig 20 for permanently locking the male terminal holder 9 which has been provisionally locked. The packing 7' is made of rubber.

A plurality of terminal receiving chambers 55 are formed in the female housing body 7 in the terminal inserting direction P, and a holder receiving space 56 is formed in a forward end of the terminal receiving chambers 55. A hood 57 is formed at an outer face of the female housing body 7 bulging forwardly.

In an inner face of the hood 57 at a side of the female housing body, is formed a circumferential hole 58 into which the packing is adapted to be press fitted. On an outer face of the hood 57, is formed a circumferential flange 59, and an annular wall 60 is projectingly formed from a circumferential edge of the flange 59 in the terminal inserting direction P. The annular wall 60 is provided by almost one third of the circumference in a counterclockwise direction from an upper part of the flange 59. A smooth sliding face 61 is formed at a forward end of the annular wall 60. The sliding face 61 includes a contact starting edge 61*a*, and a contact terminating edge 61*b* formed in a counterclockwise direction from the contact starting edge 61*a*. A projected distance T' of the annular wall 60 becomes gradually shorter in a direction from the contact starting edge 61*a* to the contact terminating edge 61*b*. The annular wall 60 ends at the contact terminating edge 61*b*.

Three cam grooves 63, 63, 63 are formed on an outer face of the hood 57. The cam grooves 63 are equidistantly or equiangularly provided and are of a same shape. Each of the cam grooves 63 is composed of a boss introducing groove 63*a*, a boss guiding groove 63*b*, and a boss locking groove 63*c*. The boss introducing groove 63*a* is formed substantially linearly from the forward end of the hood 57 in a direction P' opposite to the terminal inserting direction P. The boss guiding groove 63*b* is circumferentially formed from the boss introducing groove 63*a* by one third of the circumference in a counterclockwise direction. The boss locking groove 63*c* extends from the boss guiding groove 63*b* in a direction Q perpendicular to the terminal inserting direction P. All of the boss introducing groove 63*a*, boss guiding groove 63*b*, and boss locking groove 63*c* are in a smooth connection. A contour of the boss guiding groove 63*b* is almost the same as a shape of the forward end edge 60*a* of the annular wall 60 and a length of the boss guiding groove 63*b* is almost equal to a distance from the contact starting edge 61*a* to the contact terminating edge 61*b* of the sliding face 61.

A relation between-the cam groove 63 and the sliding face 61 is such that the boss introducing groove 63*a* is arranged along a line extending forward from the contact starting edge 61*a*. Along a line extending forward from the contact terminating edge 61*b*, is positioned the boss locking groove 63*c* at a side of the boss guiding groove 63*b*. In other words, the boss locking groove 63*c* at a side of the boss guiding groove 63*b* corresponds to the contact terminating edge 61*b*, while the opposite side to the boss guiding groove 63*b* corresponds to nothing on the sliding face 61.

A shape of the male terminal holder 9 is of the same structure as the female terminal holder 11 (See FIGS. 2 and 3), and therefore, an explanation will be omitted.

As shown in FIG. 8, the jig 20 includes a flat plate 65, four pressure projections 66, 66, 66, 66 provided at four corners of a back face 65*a* of the flat plate 65 extending rearward. A plurality of terminal introducing holes 67 are formed in the flat plate 65. The terminal introducing holes 67 correspond to the terminal receiving chambers 55 of the female housing body 7 one by one. Two of the pressure projections 66, 66 are formed with slanted faces 66*a* at their free ends.

By pushing the jig 20 into the male terminal holder 9, the male terminal holder 9 is shifted from the provisional engagement to the permanent engagement by means of the slanted faces 66*a* of the pressure projections 66.

Then, steps of assembling the electric connector housing 1, while detecting a temporarily engaged condition, will be described.

As shown in FIGS. 1 and 2, the female terminal holder 11 is inserted into the holder receiving room 13 of the male housing body 10. The locking ribs 18 of the male housing body 10 are positioned in alignment with the rib inserting cutouts 41 of the ring member 3, and the male housing body 10 is inserted into the through hole 31' of the ring member 3. While the locking ribs 18 are inserted into the rib inserting cutouts 41, the locking arms 16 are passed through the locking piece guiding cutouts 38 of the annular engaging wall 33. When the locking plate 14 of the male housing body 10 has been abutted against the annular engaging wall 33, the annular engaging wall 33 will be contained in the spaces 17 for receiving the engaging wall.

When the detecting member 4 is pushed into the detecting member receiving chamber 34 from the stopper projection 48, the stopper projection 48 overrides the locking plate 14 to be clamped by a pair of the locking ribs 18, 18. This will restrain the rotation of the ring member 3, and the position of the ring member 3 before the engaging operation will be reliably secured. On this occasion, the operating projection 49 and the operation connecting plate 47 of the detecting member 4 are projected forward from the detecting member receiving chamber 34. The male connector housing 2 is assembled in this way.

As shown in FIGS. 1 and 8, the male terminal holder 9 is provisionally engaged into the holder receiving chamber 56 of the female housing body 7. By attaching the jig 20 to the male terminal holder 9, the male terminal holder 9 is permanently locked in the holder receiving chamber 56. The packing 7' is press fitted into the packing insertion hole 58 of the female housing body 7 (See FIG. 21). The female connector housing 5 is assembled in this way.

Figure 9:
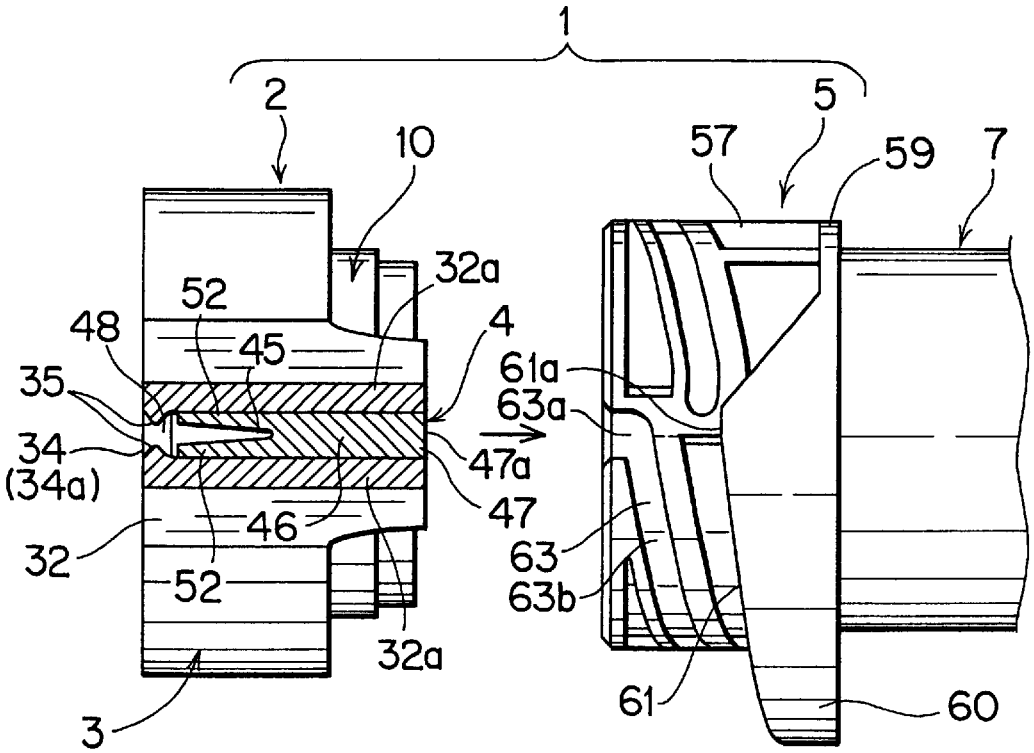
FIG. 9 is a plan view partly in section showing the male connector housing and the female connector housing before being engaged.
Figure 10:
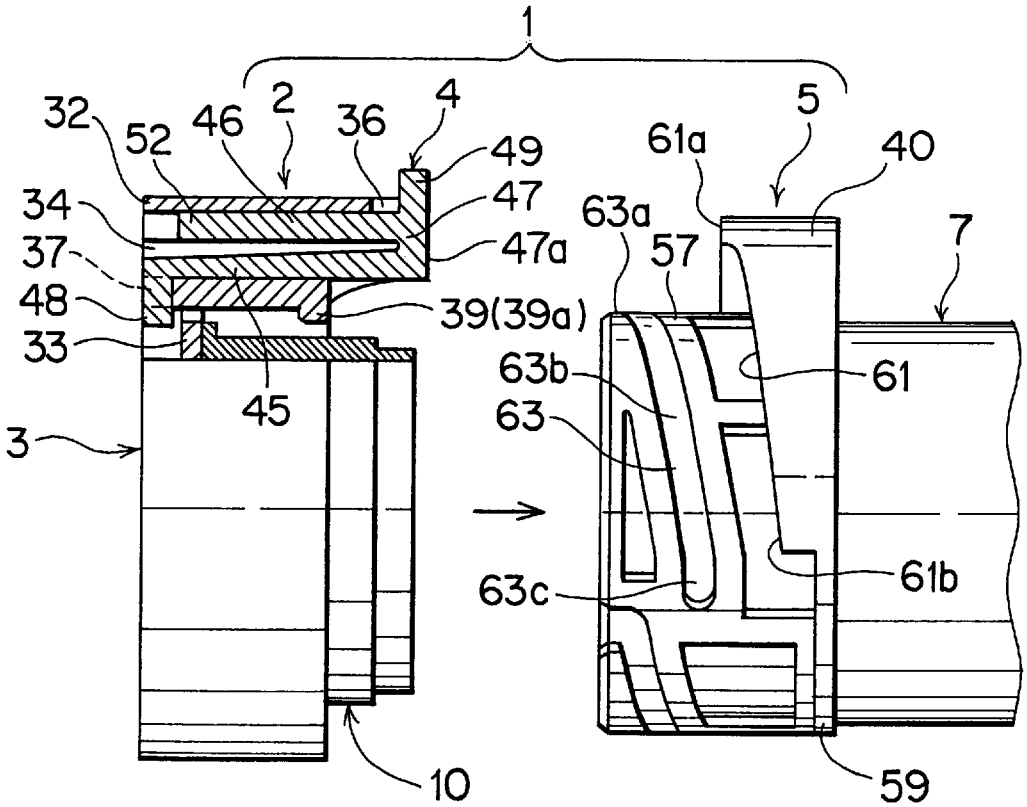
FIG. 10 is a side view partly in section showing the male connector housing and the female connector housing of FIG. 9.

Before the Start of the Engagement:

As shown in FIGS. 9 and 10, the forward end face 47*a* of the operation connecting plate 47 of the detecting member 4 which has been inserted into the receiving chamber 34 of the male connector housing 2 is positioned in alignment with the contact starting edge 61*a* of the sliding face 61. This enables the actuating bosses 39 to be faced with the boss introducing grooves 63*a* of the cam grooves 63 respectively.

Figure 11:
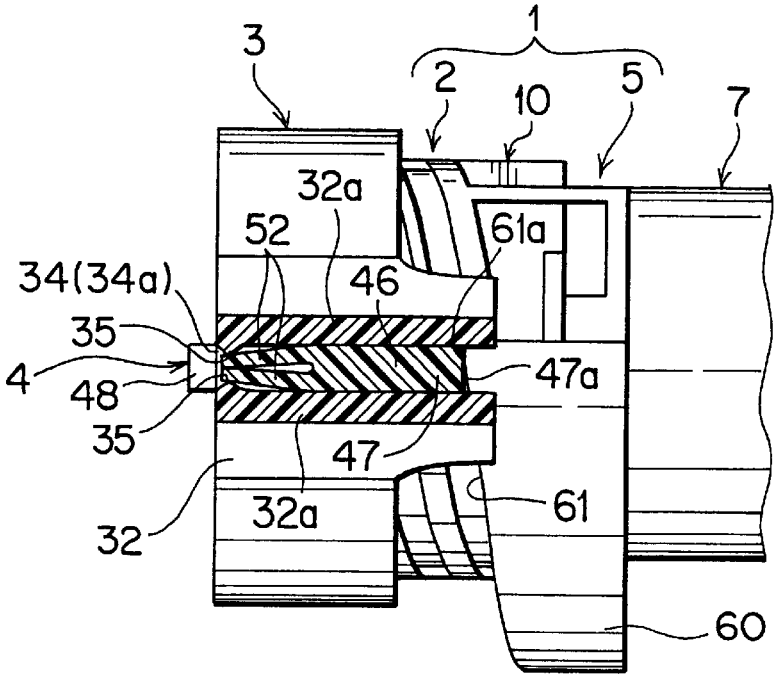
FIG. 11 is a plan view partly in section showing the male connector housing and the female connector housing at a start of the engagement.
Figure 12:
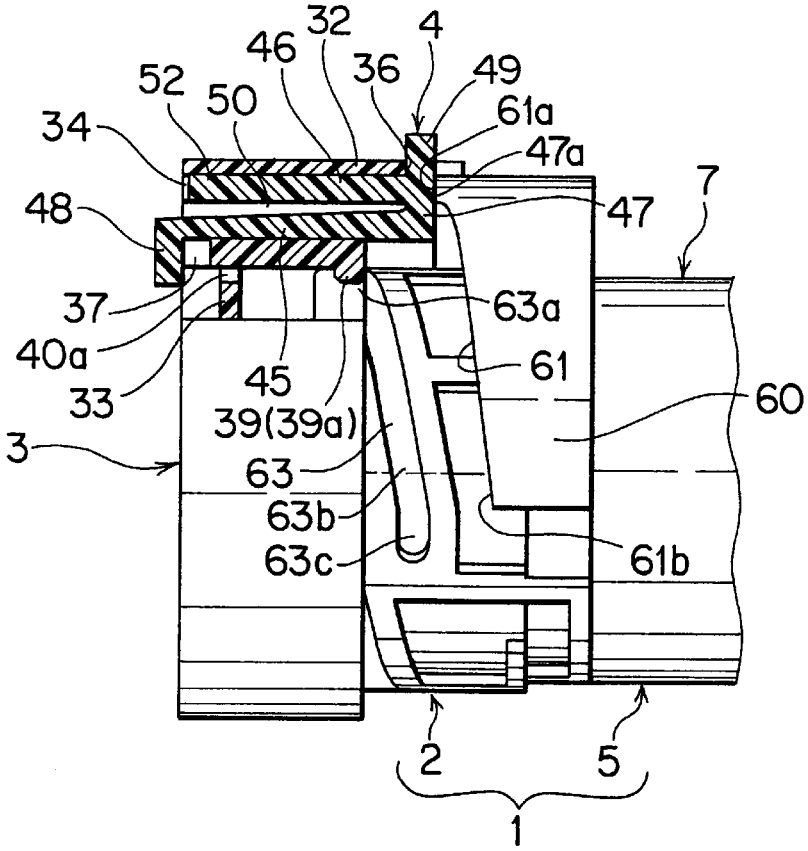
FIG. 12 is a side view of FIG. 11 partly in section.
Figure 13:
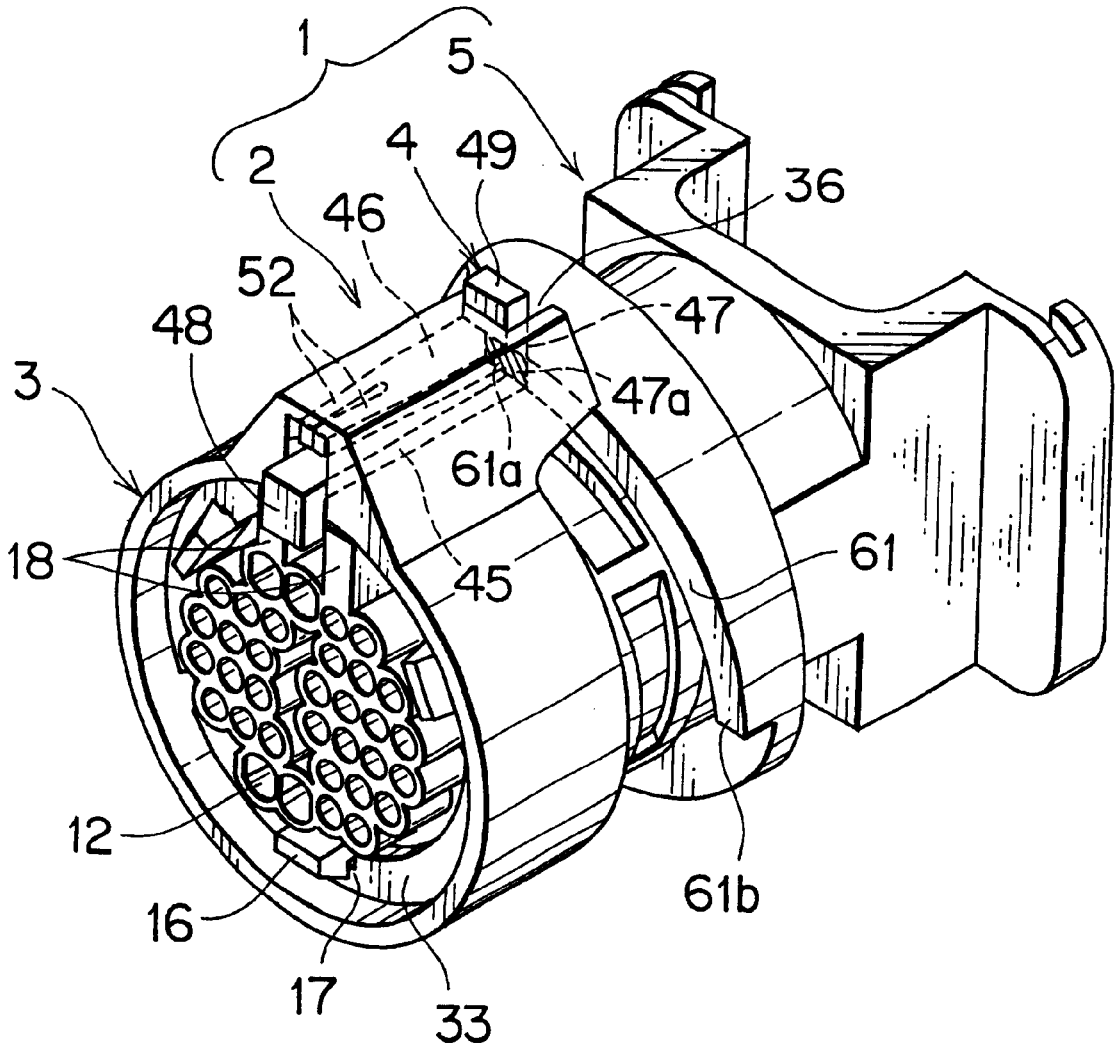
FIG. 13 is a perspective view of FIG. 11.

At the Start of the Engagement:

As shown in FIGS. 11 through 13, the male connector housing 2 is pushed into the hood 57 of the female connector housing 5 keeping the forward end face 47*a* of the operation connecting plate 47 of the detecting member 4 in alignment with the contact starting edge 61*a*. Because the rotation of the ring member 3 is restrained on this occasion, the male connector housing 2 can be pushed into the hood 57 without holding the ring member 3 different from the conventional case. The actuating bosses 39 start to be introduced into the boss introducing grooves 63*a* of the mating cam grooves 63 respectively. During the introduction of the actuating bosses 39 into the boss introducing grooves 63*a*, the forward end face 47*a* of the operation connecting plate 47 comes into abutment against the contact starting edge 61*a* of the sliding face 61.

After the abutment, the forward end face 47*a* is pressed against the sliding face 61 by an action and a counter action, and the detecting member 4 starts to move backwardly. A pair of the elastic pieces 52, 52 slide over the projected pressing walls 35 in the upper half 34*a* of the detecting member receiving chamber 34, and start to be flexed so as to be drawn near with each other. At the same time, the stopper projection 48 of the detecting member 4 follows the elastic plate 46 and starts to project rearwardly from inside of the lower half 34*b* of the detecting member receiving chamber 34. Then, the operating projection 49 begins to be introduced into the cutout 36 for the operating projection in the cylindrical member 31 of the detecting member receiving chamber 34.

When the actuating bosses 39 have been completely introduced into the boss introducing grooves 63*a*, a pair of the elastic pieces 52, 52 are pushed out rearwardly from between a pair of the projected pressing walls 35, 35. Then, the operating projection 49 is completely inserted into the cutout 36 for the operating projection in a state where the elastic plate 46 is applied with an elastic force of gradually rebounding forward. In this state, the forward end face 47*a* of the operation connecting plate 47 is urged toward the sliding face 61 of the annular wall 60 by the elastic force of the elastic plate 46.

As the stopper projection 48 is completely projected rearward from the detecting member receiving chamber 34, the restraint of the rotation of the ring member 3 will be disengaged. In short, the ring member 3 can be rotatable around the outer face of the male housing body 10 counterclockwise.

Figure 14:
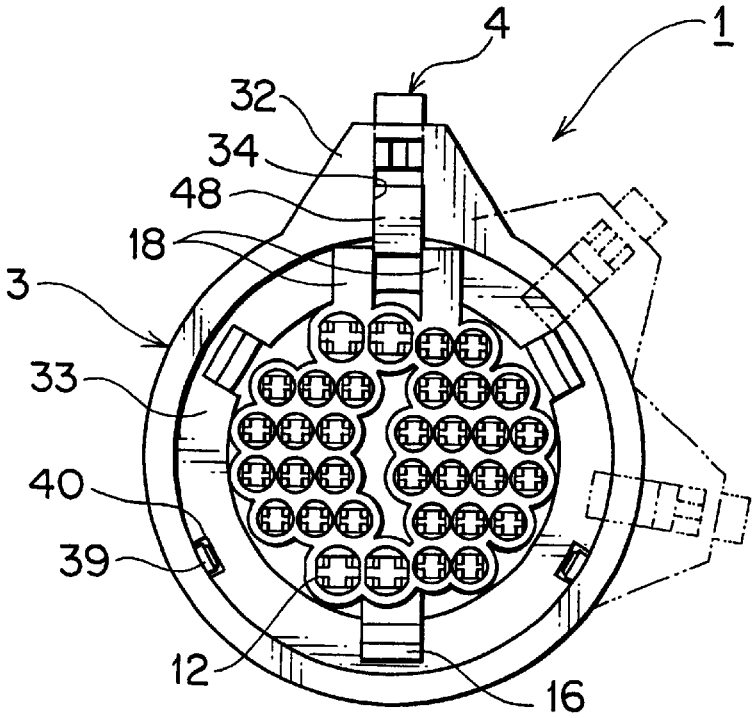
FIG. 14 is an explanatory view of the ring member showing its rotation direction with respect to the male connector housing of FIG. 1.
Figure 15:
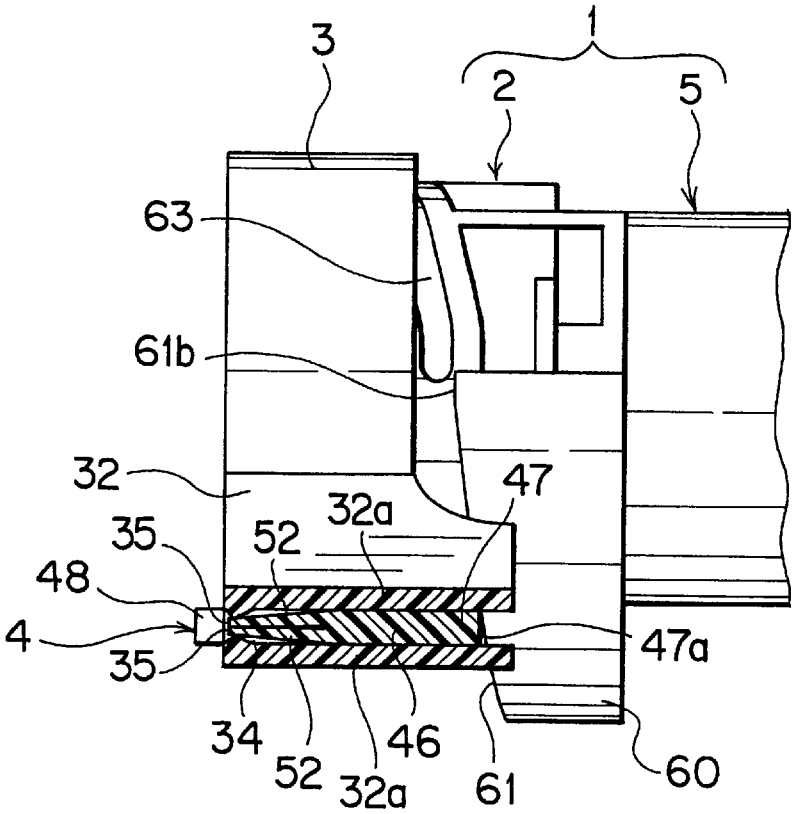
FIG. 15 is a view showing the male connector housing and the female connector housing of FIG. 1 during the engagement.
Figure 16:
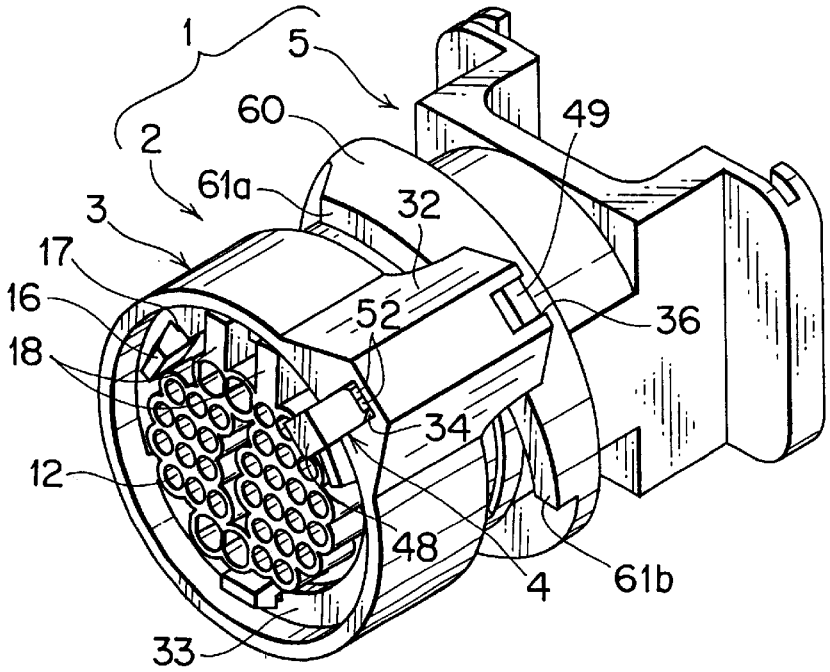
FIG. 16 is a perspective view of FIG. 15.

During the Engagement (the Rotation of the Ring Member 3):

When the ring member 3 starts to rotate counterclockwise as shown in FIG. 14, the forward end face 47*a* of the operation connecting plate 47 slides along the sliding face 61 as shown in FIGS. 15 and 16, and the actuating bosses 39 are introduced into the boss guiding grooves 63*b* (See FIG. 12). At the same time, the annular engaging wall 33 will rotate in the engaging wall receiving space 17.

With the rotation of the ring member 3, the detecting member 4 gradually moves forward from the cutout 36 for the operating projection, and at the same time, the actuating bosses 39 move counterclockwise in the boss guiding grooves 63*b*. Then, the male connector housing 2 is drawn into the hood 57, and the terminals 6, 8 in both the male connector housing 2 and the female connector housing 5 are brought into contact with each other (See FIG. 21).

Figure 17:
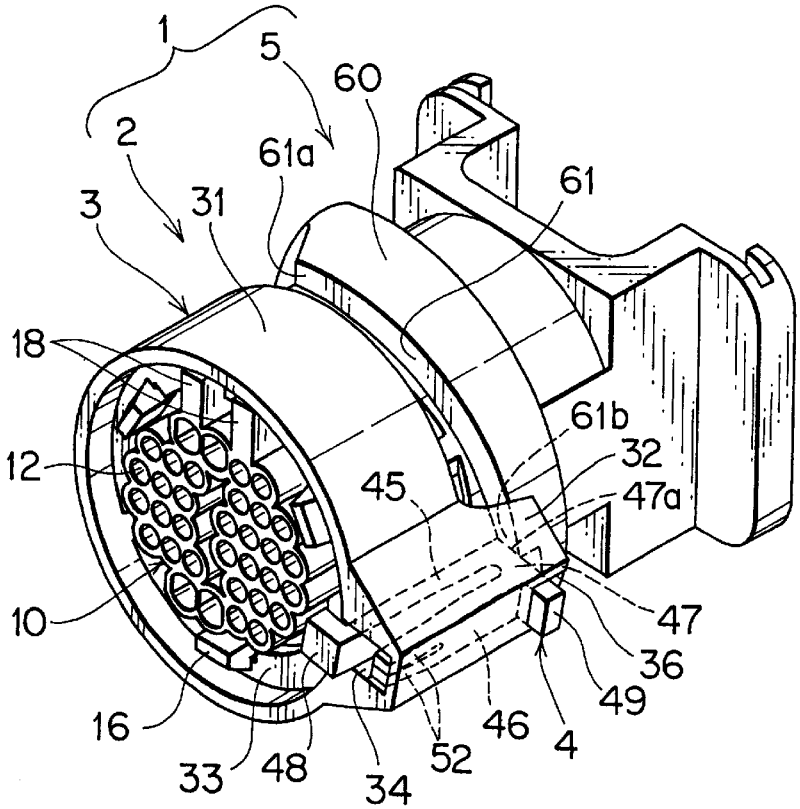
FIG. 17 is a perspective view showing the male connector housing and the female connector housing in the engaged state before termination of the rotation of the ring member.

Completion of the Engagement (Immediately Before Termination of the Rotation of the Ring Member 3):

Before the rotation of the ring member 3 is terminated, the forward end face 47*a* of the operation connecting plate 47 arrives at the contact terminating edge 61*b* of the sliding face 61 as shown in FIG. 17. In this state, the actuating bosses 39 enter into the boss locking grooves 63*c* at a side of the boss guiding grooves 63*b* (See FIG. 12), whereby the male connector housing 2 and the female connector housing 5 are engaged with each other.

Figure 18:
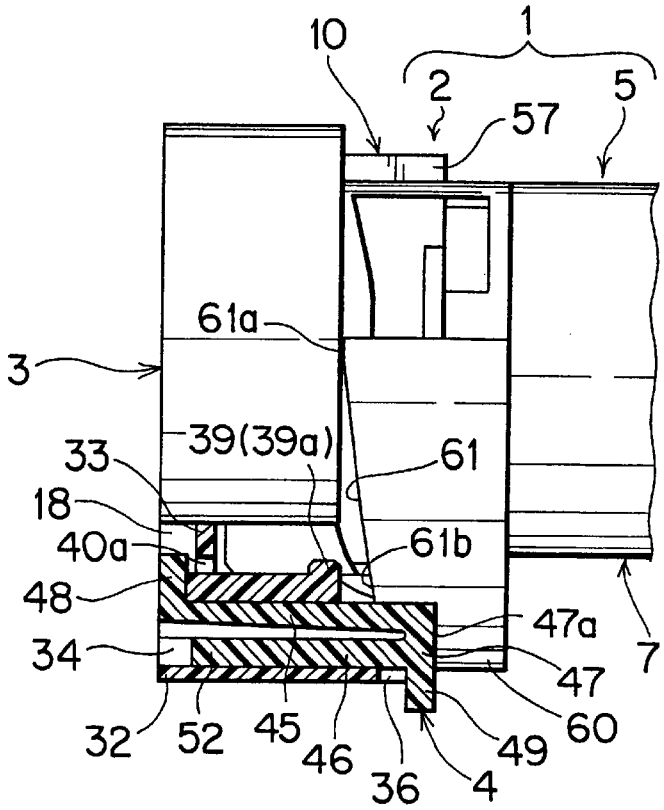
FIG. 18 is a view showing a state wherein the rotation of the ring member is terminated, after the male connector housing and the female connector housing being engaged.
Figure 19:
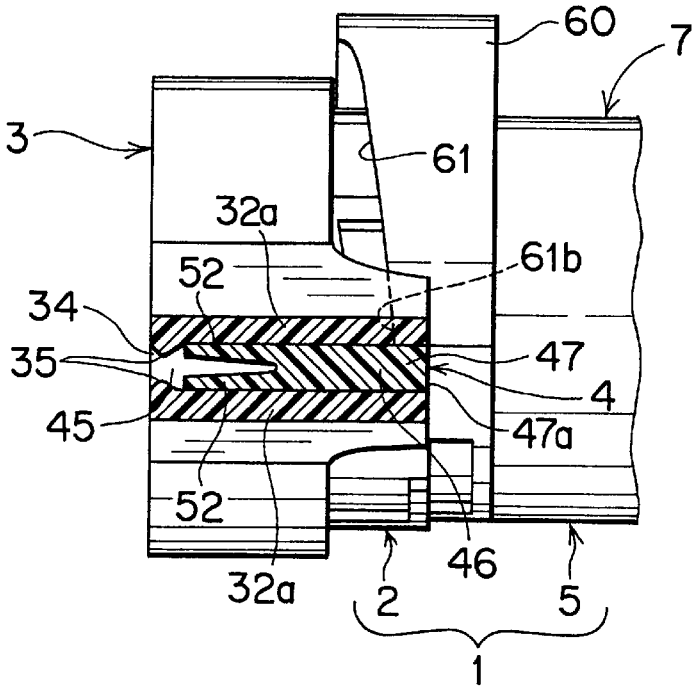
FIG. 19 is a similar view to FIG. 18 as seen from another direction.
Figure 20:
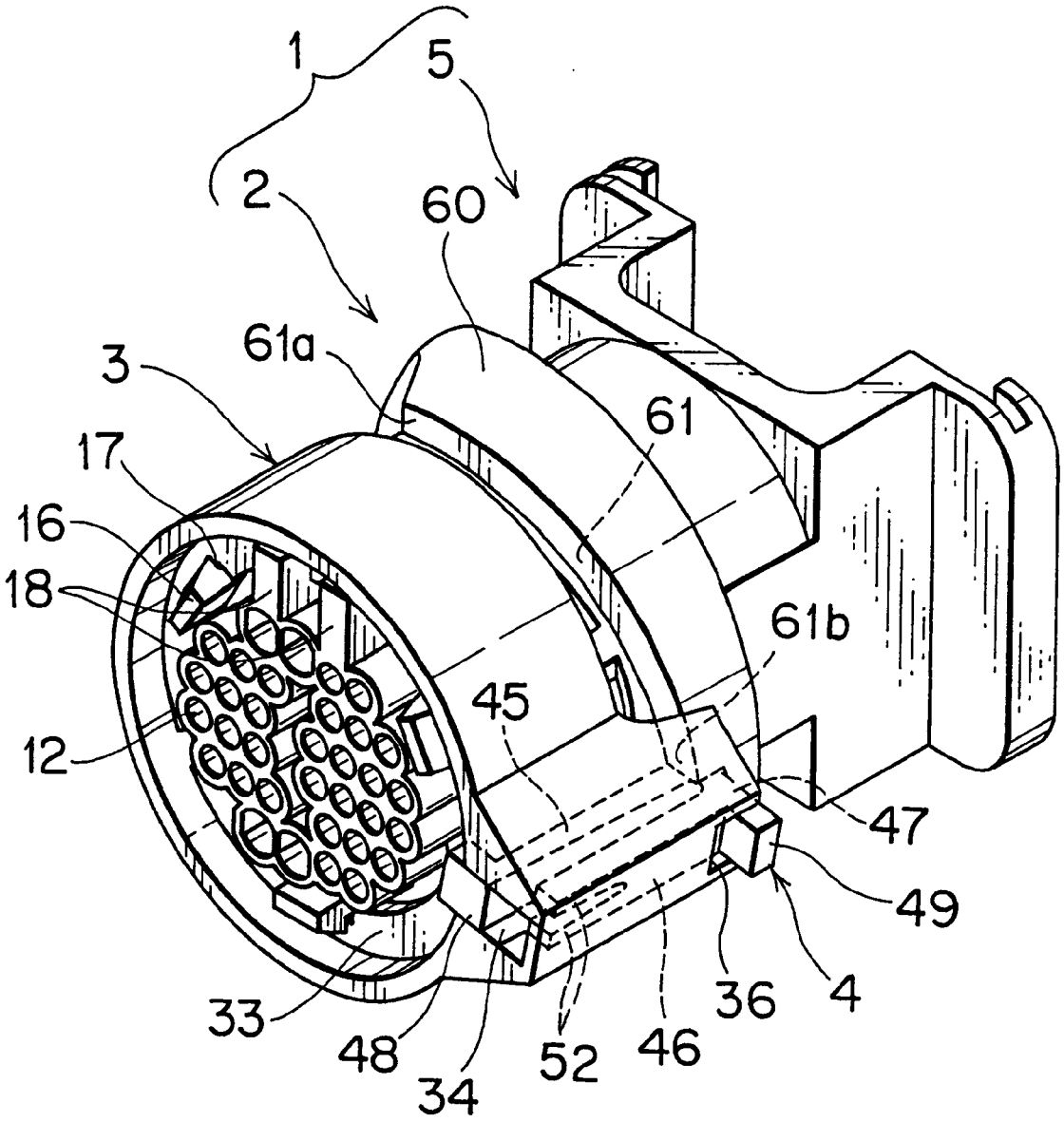
FIG. 20 is a perspective view of FIG. 18.
Figure 21:
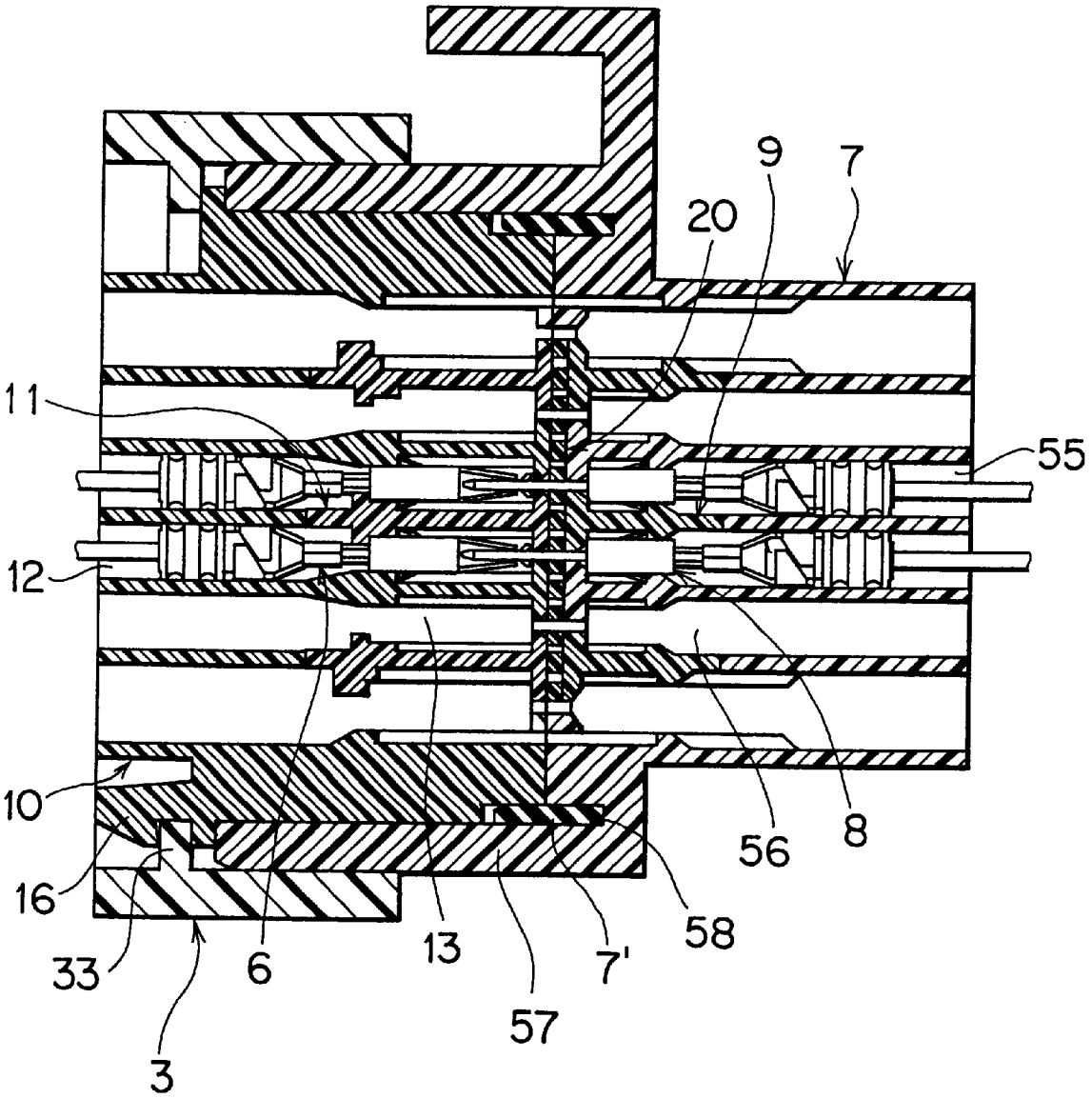
FIG. 21 is a sectional view of the female terminals and the male terminals inserted in the electric connector housing of FIG. 20 in a state where they are electricly connected.
Figure 22:
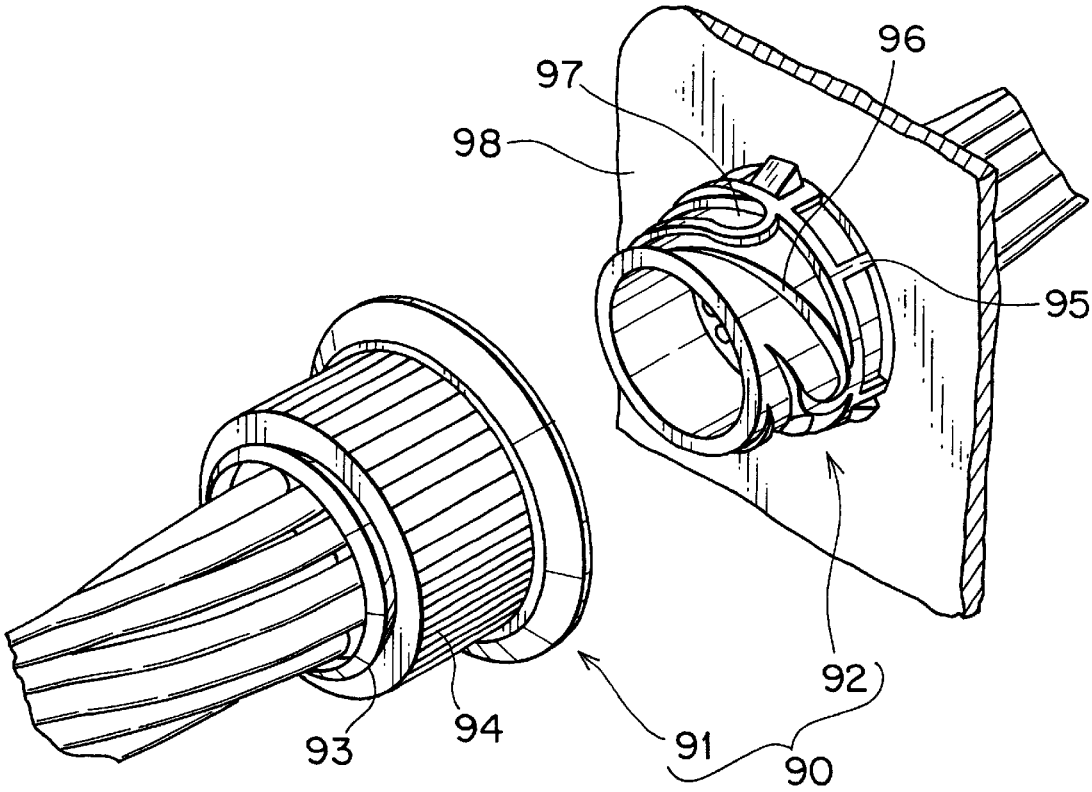
FIG. 22 PRIOR ART
FIG. 22 is a perspective view showing a conventional structure.

After the Engagement (the Termination of the Rotation of the Ring Member 3):

When the ring member 3 has been completely rotated, the forward end face 47*a* of the operation connecting plate 47 passes the contact terminating edge 61*b* as shown in FIGS. 18 through 20. As the elastic plate 46 is elastically rebounded by the elastic force stored in the elastic pieces 52, the detecting member 4 moves forward to be returned to a state before the start of the engagement. On this occasion, the clockwise rotation of the ring member 3 can be restricted by means of the operation connecting plate 47 of the detecting member 4 and the locking face 60*a* of the annular wall 60, and the counterclockwise rotation of the ring member 3 is restricted by means of the actuating bosses 39 and the boss locking grooves 63*c*. Accordingly, such a fear that the ring member 3 may be rotated by mistake after the engagement can be eliminated. Thus, reliability of the electric connector housing 1 after the engagement can be enhanced. The electric connector housing 1 is assembled in this manner, while detecting the state of the engagement in the course of the engagement. Further, the female terminals 6 inserted in the male connector housing 2 and the male terminals 8 inserted in the female connector housing 5 are electricly connected as shown in FIG. 21.

On the other hand, in case where, at the termination of the ring member 3, the detecting member 4 is not elastically returned to the state before the start of the engagement as shown in FIG. 20, or the ring member 3 cannot stop its rotation, it will be able to be judged by visual inspection that the male connector housing 2 and the female connector housing 5 have not yet been completely engaged.

In the electric connector housing 1 in the above described embodiment, the cam mechanism is utilized to engage the male connector housing 2 with the female connector housing 5.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electric connector having a pair of connector housings which are adapted to engage with each other by means of a rotation of a rotatable member fitted around an outer face of one of said connector housings, which comprises:

a receiving chamber formed on an outer face of said rotatable member radially projecting therefrom;

a member for detecting engagement of said connector housings which is disposed in said receiving chamber movable back and forth, and adapted to engage with said one of said connector housings at its one end before start of said engagement and engage with the other of said connecting housings at its other end after said engagement, thereby to stop the rotation of said rotatable member;

an annular wall which is bulgingly formed at an outer face of the other of said connector housings in a circumferential direction; and a sliding face formed on said annular wall so as to face with said rotatable member, the other end of said member for detecting the engagement being abutted against said sliding face at the start of said engagement and sliding along said sliding face during said engagement.

2. The electric connector housing as claimed in claim 1, wherein said member for detecting the engagement is adapted to be detached from said sliding face immediately after said engagement and to be elastically returned to a state before the start of said engagement.

3. A method for detecting an engagement of the electric connector housing as defined in claim 1 or 2 which comprises:

the steps of engaging a pair of said connector housings before a termination of rotation of said rotatable member; and detecting a state of the engagement of said connector housings by inspecting whether or not the member for detecting the engagement after the rotation of said rotatable member has been returned to a state before the start of said engagement.

* * * * *